US009258664B2

(12) United States Patent
Kraemer

(10) Patent No.: US 9,258,664 B2
(45) Date of Patent: Feb. 9, 2016

(54) HEADPHONE AUDIO ENHANCEMENT SYSTEM

(71) Applicant: Alan Kraemer, Irvine, CA (US)

(72) Inventor: Alan Kraemer, Irvine, CA (US)

(73) Assignee: Comhear, Inc., San Diego, CA (US)

( * ) Notice: Subject to any disclaimer, the term of this patent is extended or adjusted under 35 U.S.C. 154(b) by 70 days.

(21) Appl. No.: 14/284,832

(22) Filed: May 22, 2014

(65) Prior Publication Data

US 2014/0348358 A1 Nov. 27, 2014

Related U.S. Application Data

(60) Provisional application No. 61/826,679, filed on May 23, 2013.

(51) Int. Cl.

| | |
|---|---|
| ***H04R 5/02*** | (2006.01) |
| ***H04S 1/00*** | (2006.01) |
| ***H04S 7/00*** | (2006.01) |
| *H04R 3/08* | (2006.01) |

(52) U.S. Cl.

CPC ..... *H04S 1/005* (2013.01); *H04S 7/307* (2013.01); *H04R 3/08* (2013.01); *H04S 2420/01* (2013.01)

(58) Field of Classification Search

CPC ..... H04S 1/005; H04S 2420/01
USPC ..... 381/310
See application file for complete search history.

(56) References Cited

U.S. PATENT DOCUMENTS

| | | | |
|---|---|---|---|
| 1,616,639 | A | 2/1927 | Sprague |
| 1,951,669 | A | 3/1934 | Ramsey |
| 2,113,976 | A | 4/1938 | Bagno |
| 2,315,248 | A | 3/1943 | De Rosa |
| 2,315,249 | A | 3/1943 | De Rosa |

(Continued)

FOREIGN PATENT DOCUMENTS

| | | | |
|---|---|---|---|
| DE | 3331352 | A1 | 3/1985 |
| EP | 0729287 | A2 | 12/1983 |

(Continued)

OTHER PUBLICATIONS

Allison, R., "The Loudspeaker/ Living Room System." Audio, pp. 18-22, Nov. 1971.

(Continued)

*Primary Examiner* — Simon King
(74) *Attorney, Agent, or Firm* — Knobbe Martens Olson & Bear LLP

(57) ABSTRACT

An audio enhancement system can provide spatial enhancement, low frequency enhancement, and/or high frequency enhancement for headphone audio. The spatial enhancement can increase the sense of spaciousness or stereo separation between left and right headphone channels. The low frequency enhancement can enhance bass frequencies that are unreproducible or attenuated in headphone speakers by emphasizing harmonics of the low bass frequencies. The high frequency enhancement can emphasize higher frequencies that may be less reproducible or poorly tuned for headphone speakers. In some implementations, the audio enhancement system provides a user interface that enables a user to control the amount (e.g., gains) of each enhancement applied to headphone input signals. The audio enhancement system may also be designed to provide one or more of these enhancements more effectively when headphones with good coupling to the ear are used.

20 Claims, 12 Drawing Sheets

(56) References Cited

U.S. PATENT DOCUMENTS

| | | | |
|---|---|---|---|
| 2,461,344 | A | 2/1949 | Olson |
| 3,170,991 | A | 2/1965 | Glasgal |
| 3,229,038 | A | 1/1966 | Richter |
| 3,246,081 | A | 4/1966 | Edwards |
| 3,249,696 | A | 5/1966 | Van Sickle |
| 3,397,285 | A | 8/1968 | Golonski |
| 3,398,810 | A | 8/1968 | Clark, III |
| 3,612,211 | A | 10/1971 | Clark, III |
| 3,665,105 | A | 5/1972 | Chowning |
| 3,697,692 | A | 10/1972 | Hafler |
| 3,725,586 | A | 4/1973 | Iida |
| 3,745,254 | A | 7/1973 | Ohta et al. |
| 3,757,047 | A | 9/1973 | Ito et al. |
| 3,761,631 | A | 9/1973 | Ito et al. |
| 3,772,479 | A | 11/1973 | Hilbert |
| 3,849,600 | A | 11/1974 | Ohshima |
| 3,860,951 | A | 1/1975 | Camras |
| 3,883,692 | A | 5/1975 | Tsurushima |
| 3,885,101 | A | 5/1975 | Ito et al. |
| 3,892,624 | A | 7/1975 | Shimada |
| 3,911,220 | A | 10/1975 | Tsurushima |
| 3,916,104 | A | 10/1975 | Anazawa et al. |
| 3,921,104 | A | 11/1975 | Gundry |
| 3,925,615 | A | 12/1975 | Nakano |
| 3,943,293 | A | 3/1976 | Bailey |
| 3,944,748 | A | 3/1976 | Kuhn |
| 3,970,787 | A | 7/1976 | Searle |
| 3,989,897 | A | 11/1976 | Carver |
| 4,024,344 | A | 5/1977 | Dolby et al. |
| 4,027,101 | A | 5/1977 | DeFreitas et al. |
| 4,030,342 | A | 6/1977 | Bond et al. |
| 4,045,748 | A | 8/1977 | Filliman |
| 4,052,560 | A | 10/1977 | Santmann |
| 4,063,034 | A | 12/1977 | Peters |
| 4,069,394 | A | 1/1978 | Dol et al. |
| 4,085,291 | A | 4/1978 | Cooper |
| 4,087,629 | A | 5/1978 | Atoji et al. |
| 4,087,631 | A | 5/1978 | Yamada et al. |
| 4,097,689 | A | 6/1978 | Yamada et al. |
| 4,118,599 | A | 10/1978 | Iwahara et al. |
| 4,118,600 | A | 10/1978 | Stahl |
| 4,135,158 | A | 1/1979 | Parmet |
| 4,139,728 | A | 2/1979 | Haramoto et al. |
| 4,149,031 | A | 4/1979 | Cooper |
| 4,149,036 | A | 4/1979 | Okamoto et al. |
| 4,152,542 | A | 5/1979 | Cooper |
| 4,162,457 | A | 7/1979 | Grodinsky |
| 4,177,356 | A | 12/1979 | Jaeger et al. |
| 4,182,930 | A | 1/1980 | Blackmer |
| 4,185,239 | A | 1/1980 | Filoux |
| 4,188,504 | A | 2/1980 | Kasuga et al. |
| 4,191,852 | A | 3/1980 | Nishikawa |
| 4,192,969 | A | 3/1980 | Iwahara |
| 4,204,092 | A | 5/1980 | Bruney |
| 4,208,546 | A | 6/1980 | Laupman |
| 4,209,665 | A | 6/1980 | Iwahara |
| 4,214,267 | A | 7/1980 | Roese |
| 4,218,583 | A | 8/1980 | Poulo |
| 4,218,585 | A | 8/1980 | Carver |
| 4,219,696 | A | 8/1980 | Kogure et al. |
| 4,237,343 | A | 12/1980 | Kurtin et al. |
| 4,239,937 | A | 12/1980 | Kampmann |
| 4,239,939 | A | 12/1980 | Griffis |
| 4,251,688 | A | 2/1981 | Furner |
| 4,268,915 | A | 5/1981 | Parmet |
| 4,303,800 | A | 12/1981 | DeFreitas |
| 4,306,113 | A | 12/1981 | Morton |
| 4,308,423 | A | 12/1981 | Cohen |
| 4,308,424 | A | 12/1981 | Bice, Jr. |
| 4,308,426 | A | 12/1981 | Kikuchi |
| 4,309,570 | A | 1/1982 | Carver |
| 4,316,058 | A | 2/1982 | Christensen |
| 4,329,544 | A | 5/1982 | Yamada |
| 4,332,979 | A | 6/1982 | Fischer |
| 4,334,740 | A | 6/1982 | Wray |
| 4,349,698 | A | 9/1982 | Iwahara |
| 4,352,953 | A | 10/1982 | Emmer |
| 4,355,203 | A | 10/1982 | Cohen |
| 4,356,349 | A | 10/1982 | Robinson |
| 4,388,494 | A | 6/1983 | Schone et al. |
| 4,393,270 | A | 7/1983 | van den Berg |
| 4,394,536 | A | 7/1983 | Shima et al. |
| 4,398,158 | A | 8/1983 | Rodgers |
| 4,408,095 | A | 10/1983 | Ariga et al. |
| 4,446,488 | A | 5/1984 | Suzuki |
| 4,479,235 | A | 10/1984 | Griffs |
| 4,481,662 | A | 11/1984 | Long et al. |
| 4,489,432 | A | 12/1984 | Polk |
| 4,495,637 | A | 1/1985 | Bruney |
| 4,497,064 | A | 1/1985 | Polk |
| 4,503,554 | A | 3/1985 | Davis |
| 4,546,389 | A | 10/1985 | Gibson et al. |
| 4,549,228 | A | 10/1985 | Dieterich |
| 4,551,770 | A | 11/1985 | Palmer et al. |
| 4,553,176 | A | 11/1985 | Mendrala |
| 4,562,487 | A | 12/1985 | Hurst et al. |
| 4,567,607 | A | 1/1986 | Bruney et al. |
| 4,569,074 | A | 2/1986 | Polk |
| 4,589,129 | A | 5/1986 | Blackmer et al. |
| 4,593,696 | A | 6/1986 | Hochmair et al. |
| 4,594,610 | A | 6/1986 | Patel |
| 4,594,729 | A | 6/1986 | Weingartner |
| 4,594,730 | A | 6/1986 | Rosen |
| 4,599,611 | A | 7/1986 | Bowker et al. |
| 4,622,691 | A | 11/1986 | Tokumo et al. |
| 4,648,117 | A | 3/1987 | Kunugi et al. |
| 4,683,496 | A | 7/1987 | Tom |
| 4,696,036 | A | 9/1987 | Julstrom |
| 4,698,842 | A | 10/1987 | Mackie et al. |
| 4,703,502 | A | 10/1987 | Kasai et al. |
| 4,739,514 | A | 4/1988 | Short et al. |
| 4,748,669 | A | 5/1988 | Klayman |
| 4,790,014 | A | 12/1988 | Watanabe et al. |
| 4,803,727 | A | 2/1989 | Holt et al. |
| 4,817,149 | A | 3/1989 | Myers |
| 4,817,479 | A | 4/1989 | Myers |
| 4,819,269 | A | 4/1989 | Klayman |
| 4,831,652 | A | 5/1989 | Anderson et al. |
| 4,836,329 | A | 6/1989 | Klayman |
| 4,837,824 | A | 6/1989 | Orban |
| 4,841,572 | A | 6/1989 | Klayman |
| 4,856,064 | A | 8/1989 | Iwamatsu |
| 4,866,774 | A | 9/1989 | Klayman |
| 4,866,776 | A | 9/1989 | Kasai et al. |
| 4,888,809 | A | 12/1989 | Knibbeler |
| 4,891,560 | A | 1/1990 | Okumura et al. |
| 4,891,841 | A | 1/1990 | Bohn |
| 4,893,342 | A | 1/1990 | Cooper |
| 4,910,779 | A | 3/1990 | Cooper et al. |
| 4,953,213 | A | 8/1990 | Tasaki et al. |
| 4,955,058 | A | 9/1990 | Rimkeit et al. |
| 5,018,205 | A | 5/1991 | Takagi et al. |
| 5,033,092 | A | 7/1991 | Sadaie |
| 5,042,068 | A | 8/1991 | Scholten et al. |
| 5,046,097 | A | 9/1991 | Lowe et al. |
| 5,067,157 | A | 11/1991 | Ishida et al. |
| 5,105,462 | A | 4/1992 | Lowe et al. |
| 5,124,668 | A | 6/1992 | Christian |
| 5,146,507 | A | 9/1992 | Satoh et al. |
| 5,172,415 | A | 12/1992 | Fosgate |
| 5,177,329 | A | 1/1993 | Klayman |
| 5,180,990 | A | 1/1993 | Ohkuma |
| 5,208,493 | A | 5/1993 | Lendaro et al. |
| 5,208,860 | A | 5/1993 | Lowe et al. |
| 5,228,085 | A | 7/1993 | Aylward |
| 5,251,260 | A | 10/1993 | Gates |
| 5,255,326 | A | 10/1993 | Stevenson |
| 5,319,713 | A | 6/1994 | Waller, Jr. et al. |
| 5,325,435 | A | 6/1994 | Date et al. |
| 5,333,201 | A | 7/1994 | Waller, Jr. |
| 5,359,665 | A | 10/1994 | Werrbach |
| 5,371,799 | A | 12/1994 | Lowe et al. |
| 5,386,082 | A | 1/1995 | Higashi |
| 5,390,364 | A | 2/1995 | Webster et al. |

(56) References Cited

U.S. PATENT DOCUMENTS

| | | | | |
|---|---|---|---|---|
| 5,400,405 | A | 3/1995 | Petroff | |
| 5,412,731 | A | 5/1995 | Desper | |
| 5,420,929 | A | 5/1995 | Geddes et al. | |
| 5,452,364 | A | 9/1995 | Bonham | |
| 5,459,813 | A | 10/1995 | Klayman | |
| 5,533,129 | A | 7/1996 | Gefvert | |
| 5,596,931 | A | 1/1997 | Rossler et al. | |
| 5,610,986 | A | 3/1997 | Miles | |
| 5,638,452 | A | 6/1997 | Waller et al. | |
| 5,661,808 | A | 8/1997 | Klayman | |
| 5,668,885 | A | 9/1997 | Oda | |
| 5,771,295 | A | 6/1998 | Waller, Jr. | |
| 5,771,296 | A | 6/1998 | Unemura | |
| 5,784,468 | A | 7/1998 | Klayman | |
| 5,822,438 | A | 10/1998 | Sekine et al. | |
| 5,832,438 | A | 11/1998 | Bauer | |
| 5,841,879 | A | 11/1998 | Scofield et al. | |
| 5,850,453 | A | 12/1998 | Klayman et al. | |
| 5,862,228 | A | 1/1999 | Davis | |
| 5,872,851 | A | 2/1999 | Petroff | |
| 5,892,830 | A | 4/1999 | Klayman | |
| 5,912,976 | A | 6/1999 | Klayman | |
| 5,930,370 | A | 7/1999 | Ruzicka | |
| 5,930,375 | A | 7/1999 | East et al. | |
| 5,999,630 | A | 12/1999 | Iwamatsu | |
| 6,134,330 | A | 10/2000 | De Poortere et al. | |
| 6,175,631 | B1 | 1/2001 | Davis et al. | |
| 6,281,749 | B1 | 8/2001 | Klayman et al. | |
| 6,285,767 | B1 | 9/2001 | Klayman | |
| 6,430,301 | B1 | 8/2002 | Petrovic | |
| 6,470,087 | B1 | 10/2002 | Heo et al. | |
| 6,504,933 | B1 | 1/2003 | Chung | |
| 6,590,983 | B1 | 7/2003 | Kraemer | |
| 6,597,791 | B1 | 7/2003 | Klayman | |
| 6,614,914 | B1 | 9/2003 | Rhoads et al. | |
| 6,647,389 | B1 | 11/2003 | Fitch et al. | |
| 6,694,027 | B1 | 2/2004 | Schneider | |
| 6,718,039 | B1 | 4/2004 | Klayman et al. | |
| 6,737,957 | B1 | 5/2004 | Petrovic et al. | |
| 6,766,305 | B1 | 7/2004 | Fucarile et al. | |
| 7,031,474 | B1 | 4/2006 | Yuen et al. | |
| 7,043,031 | B2 | 5/2006 | Klayman et al. | |
| 7,200,236 | B1 | 4/2007 | Klayman et al. | |
| 7,212,872 | B1 | 5/2007 | Smith et al. | |
| 7,277,767 | B2 | 10/2007 | Yuen et al. | |
| 7,451,093 | B2 | 11/2008 | Kraemer | |
| 7,457,415 | B2 | 11/2008 | Reitmeier et al. | |
| 7,467,021 | B2 | 12/2008 | Yuen et al. | |
| 7,492,907 | B2 | 2/2009 | Klayman et al. | |
| 7,522,733 | B2 | 4/2009 | Kraemer et al. | |
| 7,555,130 | B2 | 6/2009 | Klayman et al. | |
| 7,606,716 | B2 | 10/2009 | Kraemer | |
| 7,801,734 | B2 | 9/2010 | Kraemer | |
| 7,907,736 | B2 | 3/2011 | Yuen et al. | |
| 7,987,281 | B2 | 7/2011 | Yuen et al. | |
| 8,046,093 | B2 | 10/2011 | Yuen et al. | |
| 8,050,434 | B1 | 11/2011 | Kato et al. | |
| 8,396,575 | B2 | 3/2013 | Kraemer et al. | |
| 8,396,576 | B2 | 3/2013 | Kraemer et al. | |
| 8,396,577 | B2 | 3/2013 | Kraemer et al. | |
| 8,472,631 | B2 | 6/2013 | Klayman et al. | |
| 8,509,464 | B1 | 8/2013 | Kato et al. | |
| 2001/0012370 | A1 | 8/2001 | Klayman et al. | |
| 2001/0020193 | A1 | 9/2001 | Teramachi et al. | |
| 2002/0129151 | A1* | 9/2002 | Yuen | H04S 3/002 709/229 |
| 2002/0157005 | A1 | 10/2002 | Brunk et al. | |
| 2003/0115282 | A1 | 6/2003 | Rose | |
| 2004/0005066 | A1 | 1/2004 | Kraemer | |
| 2004/0136554 | A1* | 7/2004 | Kirkeby | H04S 1/005 381/309 |
| 2004/0247132 | A1 | 12/2004 | Klayman et al. | |
| 2005/0071028 | A1 | 3/2005 | Yuen et al. | |
| 2005/0129248 | A1 | 6/2005 | Kraemer et al. | |
| 2005/0246179 | A1 | 11/2005 | Kraemer | |
| 2006/0062395 | A1 | 3/2006 | Klayman et al. | |
| 2006/0126851 | A1 | 6/2006 | Yuen et al. | |
| 2006/0206618 | A1 | 9/2006 | Zimmer et al. | |
| 2006/0215848 | A1* | 9/2006 | Ambourn | H04S 1/005 381/74 |
| 2007/0165868 | A1 | 7/2007 | Klayman et al. | |
| 2007/0250194 | A1 | 10/2007 | Rhoads et al. | |
| 2008/0015867 | A1 | 1/2008 | Kraemer | |
| 2008/0022009 | A1 | 1/2008 | Yuen et al. | |
| 2009/0094519 | A1 | 4/2009 | Yuen et al. | |
| 2009/0132259 | A1 | 5/2009 | Kraemer | |
| 2009/0190766 | A1 | 7/2009 | Klayman et al. | |
| 2009/0252356 | A1* | 10/2009 | Goodwin | H04S 1/002 381/310 |
| 2011/0040395 | A1 | 2/2011 | Kraemer et al. | |
| 2011/0040396 | A1 | 2/2011 | Kraemer et al. | |
| 2011/0040397 | A1 | 2/2011 | Kraemer et al. | |
| 2011/0274279 | A1 | 11/2011 | Yuen et al. | |
| 2011/0286602 | A1 | 11/2011 | Yuen et al. | |
| 2012/0170756 | A1 | 7/2012 | Kraemer et al. | |
| 2012/0170757 | A1 | 7/2012 | Kraemer et al. | |
| 2012/0170759 | A1 | 7/2012 | Yuen et al. | |
| 2012/0230497 | A1 | 9/2012 | Dressler et al. | |
| 2012/0232910 | A1 | 9/2012 | Dressler et al. | |
| 2013/0202117 | A1* | 8/2013 | Brungart | H04R 5/04 381/17 |
| 2013/0202129 | A1 | 8/2013 | Kraemer et al. | |
| 2014/0044288 | A1 | 2/2014 | Kato et al. | |

FOREIGN PATENT DOCUMENTS

| | | | |
|---|---|---|---|
| EP | 0546619 | A2 | 6/1993 |
| EP | 0095902 | A1 | 8/1996 |
| EP | 0756437 | | 3/2006 |
| JP | S58146200 | A | 8/1983 |
| JP | H05300596 | A | 11/1993 |
| JP | 09224300 | | 8/1997 |
| JP | 40-29936 | | 1/2008 |
| JP | 4-312585 | | 8/2009 |
| WO | WO 96/34509 | | 4/1996 |
| WO | WO 97/42789 | | 11/1997 |
| WO | WO 98/20709 | | 5/1998 |
| WO | WO 98/21915 | | 5/1998 |
| WO | WO 98/46044 | | 10/1998 |
| WO | WO 99/26454 | | 5/1999 |
| WO | WO 01/61987 | | 8/2001 |

OTHER PUBLICATIONS

Boney L. et al., "Digital Watermarks for Audio Signals," Proceedings of the International Conference on Multimedia Computing and Systems, Los Alamitos, CA, US; Jun. 17, 1996, pp. 473-480.

Gilman, "Some Factors Affecting the Performance of Airline Entertainment Headsets", J. Audio Eng. Soc., vol. 31, No. 12, Dec. 1983.

Ishihara, M., "A new Analog Signal Processor for a Stereo Enhancement System," IEEE Transactions on Consumer Electronics, vol. 37, No. 4, pp. 806-813, Nov. 1991.

Japanese Office Action Final Notice of Rejection issued in application No. 2001-528430 on Feb. 2, 2010.

Kauffman, Richard J., "Frequency Contouring for Image Enhancement," Audio, pp. 34-39, Feb. 1985.

Kurozumi, K., et al., "A New Sound Image Broadening Control System Using a Correlation Coefficient Variation Method," Electronics and Communications in Japan, vol. 67-A, No. 3, pp. 204-211, Mar. 1984.

PCT International Search Report and Preliminary Examination Report; International Application No. PCT/US00/27323 issued on Jul. 11, 2001.

Phillips Components, "Integrated Circuits Data Handbook: Radio, audio and associated systems, Bipolar, MOS, CA3089 to TDA1510A," Oct. 7, 1987, pp. 103-110.

Schroeder, M.R., "An Artificial Stereophonic Effect Obtained from a Single Audio Signal," Journal of the Audio Engineering Society, vol. 6, No. 2, pp. 74-79, Apr. 1958.

(56) References Cited

OTHER PUBLICATIONS

Stock, "The New Featherweight Headphones", Audio, pp. 30-32, May 1981.
Vaughan, D., "How We Hear Direction," Audio, pp. 51-55, Dec. 1983.
Wilson, Kim, "AC-3 Is Here! But Are You Ready to Pay the Price?" Home Theater, pp. 60-65, Jun. 1995.
International Search Report and Written Opinion issued in application No. PCT/US2014/039115 on Oct. 10, 2014.

* cited by examiner

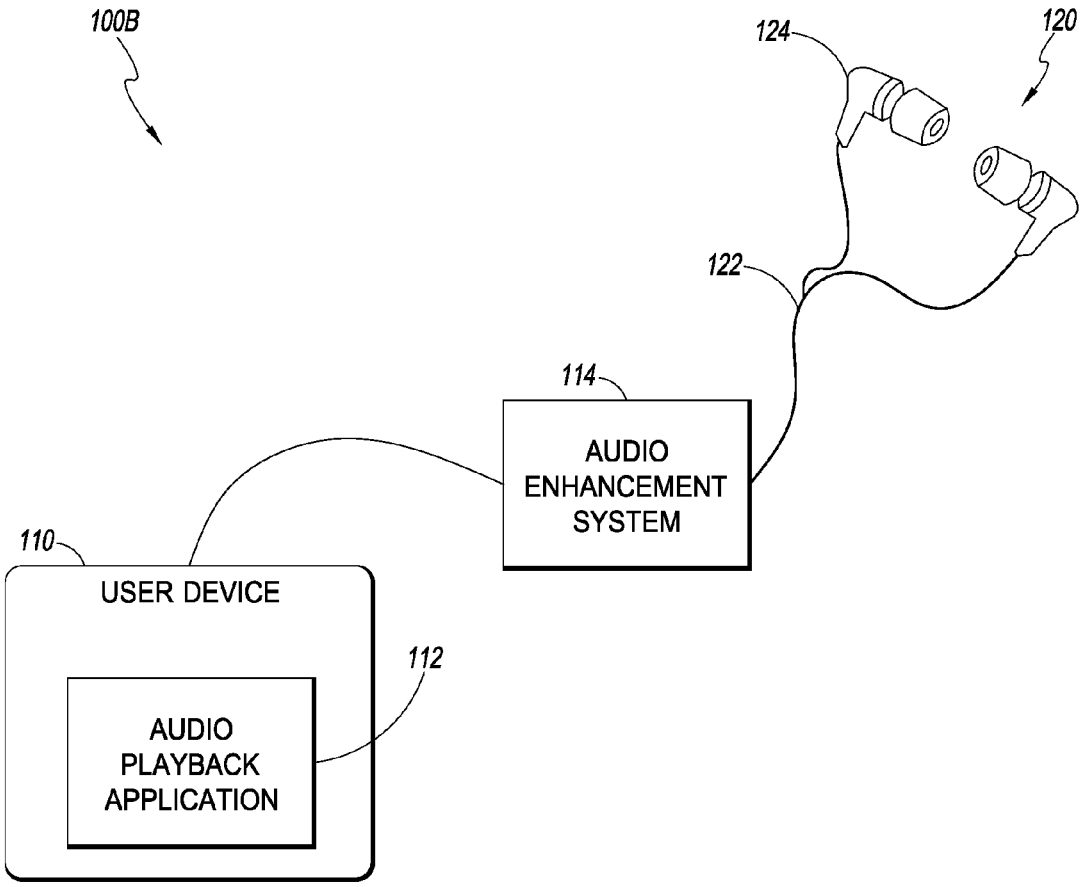
FIG. IB

HEADPHONE AUDIO ENHANCEMENT SYSTEM

RELATED APPLICATION

This application claims priority under 35 U.S.C. §119(e) as a nonprovisional application of U.S. Provisional Application No. 61/826,679, filed May 23, 2013 titled "Audio Processor," the disclosure of which is hereby incorporated by reference in its entirety.

BACKGROUND

When a user listens to music with headphones, audio signals that are mixed to come from the left or right side sound to the user as if they are located adjacent to the left and right ears. Audio signals that are mixed to come from the center sound to the listener as if they are located in the middle of the listener's head. This placement effect is due to the recording process, which assumes that audio signals will be played through speakers that will create a natural dispersion of the reproduced audio signals within a room, where the room provides a sound path to both ears. Playing audio signals through headphones sounds unnatural in part because there is no sound path to both ears.

SUMMARY

For purposes of summarizing the disclosure, certain aspects, advantages and novel features of several embodiments are described herein. It is to be understood that not necessarily all such advantages can be achieved in accordance with any particular embodiment of the embodiments disclosed herein. Thus, the embodiments disclosed herein can be embodied or carried out in a manner that achieves or optimizes one advantage or group of advantages as taught herein without necessarily achieving other advantages as may be taught or suggested herein.

In certain embodiments, a method of enhancing audio for headphones can be implemented under control of a hardware processor. The method can include receiving a left input audio signal, receiving a right input audio signal, obtaining a difference signal from the left and right input audio signals, filtering the difference signal at least with a notch filter to produce a spatially-enhanced audio signal, filtering the left and right input audio signals with at least two band pass filters to produce bass-enhanced audio signals, filtering the left and right input audio signals with a high pass filter to produce high-frequency enhanced audio signals, mixing the spatially-enhanced audio signal, the bass-enhanced audio signals, and the high-frequency enhanced audio signals to produce left and right headphone output signals, and outputting the left and right headphone output signals to headphones for playback to a listener.

The method of the preceding paragraph may be implemented with any combination of the following features: the notch filter of the spatial enhancer can attenuate frequencies in a frequency band associated with speech; the notch filter can attenuate frequencies in a frequency band centered at about 2500 Hz; the notch filter can attenuate frequencies in a frequency band of at least about 2100 Hz to about 2900 Hz; a spatial enhancement provided by the notch filter can be effective when the headphones are closely coupled with the listener's ears; the band pass filters can emphasize harmonics of a fundamental that may be attenuated or unreproducible by headphones; and the high pass filter can have a cutoff frequency of about 5 kHz.

In certain embodiments, a system for enhancing audio for headphones can include a spatial enhancer that can obtain a difference signal from a left input channel of audio and a right input channel of audio and to process the difference signal with a notch filter to produce a spatially-enhanced channel of audio. The system can further include a low frequency enhancer that can process the left input channel of audio and the right input channel of audio to produce bass-enhanced channels of audio. The system may also include a high frequency enhancer that can process the left input channel of audio and the right input channel of audio to produce high-frequency enhanced channels of audio. In addition, the system can include a mixer that can combine the spatially-enhanced channel of audio, the bass-enhanced channels of audio, and the high-frequency enhanced channels of audio to produce left and right headphone output channels. Moreover, the spatial enhancer, the low frequency enhancer, the high frequency enhancer, and the mixer can be implemented by one or more hardware processors.

The system of the preceding paragraph may be implemented with any combination of the following features: the notch filter of the spatial enhancer can attenuate frequencies in a frequency band associated with speech; the notch filter can attenuate frequencies in a frequency band centered at about 2500 Hz; the notch filter can attenuate frequencies in a frequency band of at least about 2100 Hz to about 2900 Hz; a spatial enhancement provided by the notch filter can be effective when the headphones are closely coupled with the listener's ears; the band pass filters can emphasize harmonics of a fundamental that may be attenuated or unreproducible by headphones; and the high pass filter can have a cutoff frequency of about 5 kHz.

In various embodiments, non-transitory physical computer storage includes instructions stored thereon that, when executed by a hardware processor, can implement a system for enhancing audio for headphones. The system can filter left and right input audio signals with a notch filter to produce spatially-enhanced audio signals. The system can also obtain a difference signal from the spatially-enhanced audio signals. The system may also filter the left and right input audio signals with at least two band pass filters to produce bass-enhanced audio signals. Moreover, the system may filter the left and right input audio signals with a high pass filter to produce high-frequency enhanced audio signals. Additionally, the system may mix the difference signal, the bass-enhanced audio signals, and the high-frequency enhanced audio signals to produce left and right headphone output signals.

BRIEF DESCRIPTION OF THE DRAWINGS

Throughout the drawings, reference numbers are re-used to indicate correspondence between referenced elements. The drawings are provided to illustrate embodiments of the features described herein and not to limit the scope thereof.

FIGS. 1A and 1B depict example embodiments of enhanced audio playback systems.

DETAILED DESCRIPTION

I. Introduction

With loudspeakers placed in a room, the width between the loudspeakers can create a stereo effect that may be perceived by a listener as providing a spatial, ambient sound. With headphones, due to the close position of the headphone speakers to a listener's ears and the bypassing of the outer ear, an inaccurate overly discrete stereo effect perceived by a listener. This discrete stereo effect may be less immersive than a stereo effect provided by stereo loudspeakers. Many headphones are also poor at reproducing certain low-bass and high frequencies, resulting in a poor listening experience for many listeners.

This disclosure describes embodiments of an audio enhancement system that can provide spatial enhancement, low frequency enhancement, and/or high frequency enhancement for headphone audio. In an embodiment, the spatial enhancement can increase the sense of spaciousness or stereo separation between left and right headphone channels and eliminate the "in the head" effect typically presented by headphones. The low frequency enhancement can enhance bass frequencies that are unreproducible or attenuated in headphone speakers by emphasizing harmonics of the low bass frequencies. The high frequency enhancement can emphasize higher frequencies that may be less reproducible or poorly tuned for headphone speakers. In some embodiments, the audio enhancement system can provide a user interface that enables a user to control the amount (e.g., gains) of each enhancement applied to headphone input signals. The audio enhancement system may also be designed to provide one or more of these enhancements more effectively when headphones with good coupling to the ear are used.

For purposes of summarizing the disclosure, certain aspects, advantages and novel features of several embodiments are described herein. It is to be understood that not necessarily all such advantages can be achieved in accordance with any particular embodiment of the embodiments disclosed herein. Thus, the embodiments disclosed herein can be embodied or carried out in a manner that achieves or optimizes one advantage or group of advantages as taught herein without necessarily achieving other advantages as may be taught or suggested herein.

II. Example Embodiments

Figure 1A:
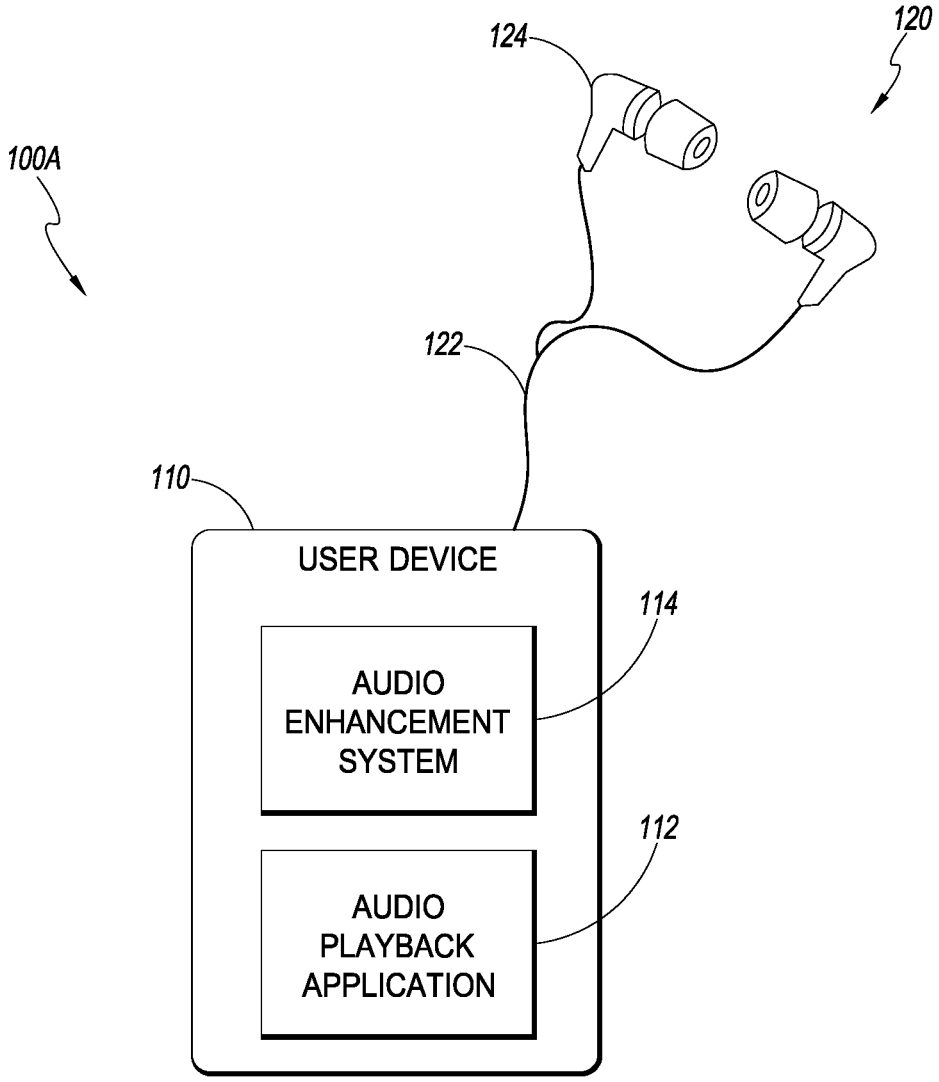

FIGS. 1A and 1B depict example embodiments of enhanced audio playback systems 100A, 100B (sometimes collectively referred to as the enhanced audio playback system 100). In FIG. 1A, the enhanced audio playback system 100A includes a user device 110 and headphones 120. The user device 110 includes an audio enhancement system 114 and an audio playback application 112. FIG. 1B includes all of the features of FIG. 1A, except that the audio enhancement system 114 is located in the headphones 120 instead of in the user device 110. In particular, the audio enhancement system 114 is located in a cable 122 of the headphones in FIG. 1B.

Advantageously, in certain embodiments, the audio enhancement system 114 can provide enhancements to audio for low-frequency enhancements, high-frequency enhancements, and/or spatial enhancements. These audio enhancements can be used to improve headphone audio for music, videos, television, moves, gaming, conference calls, and the like.

The user device 110 can be any device that includes a hardware processor that can perform the functions associated with the audio enhancement system 114 and/or the audio playback application 112. For instance, the user device 110 can be any computing device or any consumer electronics device, some examples including a television, laptop, desktop, phone (e.g., smartphone or other cell phone), tablet computer, phablet, gaming station, ebook reader, and the like.

The audio playback application 112 can include hardware and/or software for playing back audio, including audio that may be locally stored, downloaded or streamed over a network (not shown), such as the Internet. In the example where the user device 110 is a television or an audio/visual system, the audio playback application 112 can access audio from a media disc, such as a Blu-ray disc or the like. Alternatively, the audio playback application 112 can access the audio from a hard drive or, as described above, from a remote network application or web site over the Internet.

The audio enhancement system 114 can be implemented as software and/or hardware. For example, the audio enhancement system 114 can be implemented as software or firmware executing on a hardware processor, such as a general purpose processor programmed with specific instructions to become a specific purpose processor, a digital signal processor programmed with specific instructions to become a specific purpose processor, or the like. The processor may be a fixed or floating-point processor. In another embodiment, the audio enhancement system 114 can be implemented as programmed logic in a logic-programmable processor, such as a field programmable gate array (FPGA) or the like. Additional examples of processors are described in greater detail below in the "Terminology" section.

In an embodiment, the audio enhancement system 114 is an application that may be downloaded from an online application store, such as the Apple™ App Store or the Google Play store for Android™ devices. The audio enhancement system 114 can interact with an audio library in the user device 110 to access audio functionality of the device 110. In an embodiment, the audio playback application 112 executes program call(s) to the audio enhancement system 114 to cause the audio enhancement system 114 to enhance audio for playback. Conversely, the audio enhancement system 114 may execute program call(s) to the audio playback application 112 to cause playback of enhanced audio to occur. In another embodiment, the audio playback application 112 is part of the audio enhancement system 114 or vice versa.

Advantageously, in certain embodiments, the audio enhancement system 114 can provide one or more audio enhancements that are designed to work well with headphones. In some embodiments, these audio enhancements may be more effective when headphones have good coupling to the ear. An example of headphones 120 connected to the user device 110 via a cable 122 are shown. These headphones 120 are example ear-bud headphones (described in greater detail below with respect to FIG. 2) that may be inserted into a listener's ear canal and that can provide good coupling to a user's ear. Another example of headphones that may provide good coupling to a user's ears are circum-aural or over-the-ear headphones.

In other embodiments, some or all of the features described herein as being implemented by the audio enhancement system 114 may also be implemented when the user device 110 is connected to loudspeakers instead of headphones 120. In loudspeaker embodiments, the audio enhancement system 114 may also perform cross-talk canceling to reduce speaker crosstalk between a listener's ears.

As described above, the audio enhancement system 114 can provide a low-frequency enhancement that can enhance the low-frequency response of the headphones 120. Enhancing the low frequency response may be beneficial for headphone speakers because speakers in headphones 120 are relatively small and may have a poor low-bass response. In addition, the audio enhancement system 114 can enhance high frequencies of the headphone speakers 120. Further, the audio enhancement system 114 can provide a spatial enhancement that may increase the sense of spaciousness or stereo separation between headphone channels. Further, the audio enhancement system 114 may implement any sub-combination of low-frequency, high-frequency, and spatial enhancements, among other enhancements.

Referring to FIG. 1B in more detail, as mentioned above, the audio enhancement system 114 may be implemented in the cable 122 of the headphones 120 or directly in the earpieces 124 of the headphones 120. The audio enhancement system 114 in FIG. 1B may include all of the features of the audio enhancement system 114 of FIG. 1A. The audio enhancement system 114 can include one or more processors that can implement firmware, software, and/or program logic to perform the enhancements described herein. In addition, the audio enhancement system 114 may include a battery or other power source that provides power to the hardware of the audio enhancement system 114. The audio enhancement system 114 may instead derive power directly from a connection with the user device 110. Further, the audio enhancement system may have one or more user controls, such as controls for effecting volume or other parameter(s) of the one or more enhancements of the audio enhancement system 114. Example controls might include, in addition to volume control, a low-frequency gain control, a high-frequency gain control, a spatial gain control, and the like. These controls may be provided as hardware buttons or software buttons as part of an optional display included in the audio enhancement system 114.

In some embodiments, it can be useful to provide the headphones 120 with the audio enhancement system 114 in the cable 122 or earpieces 124, as opposed to in the user device 110. One example use case for doing so is to enable compatibility of the audio enhancement system 114 with some user devices 110 that do not have open access to audio libraries, such that the audio enhancement system 114 cannot run completely or even at all on the user device 110. In addition, in some embodiments, even when the user device 110 may be compatible with running the audio enhancement system 114, it may still be useful to have the audio enhancement system 114 in the headphones 120.

Further, although not shown, the user device 110 in FIG. 1B may be modified to further include some or all of the features of the audio enhancement system 114. For instance, the audio enhancement system installed on the user device 110 can provide a user interface that gives functionality for a user to adjust one or more parameters of the audio enhancement system 114 installed in the headphones 120, instead of or in addition to those parameters being adjustable directly from the audio enhancement system 114 in the headphones 120. Further, in another embodiment, one or more enhancements of the audio enhancement system 114 may be implemented by the audio enhancement system 114 in the headphones 120 and one or more other enhancements may be implemented in the audio enhancement system in the user device 110.

Figure 2:
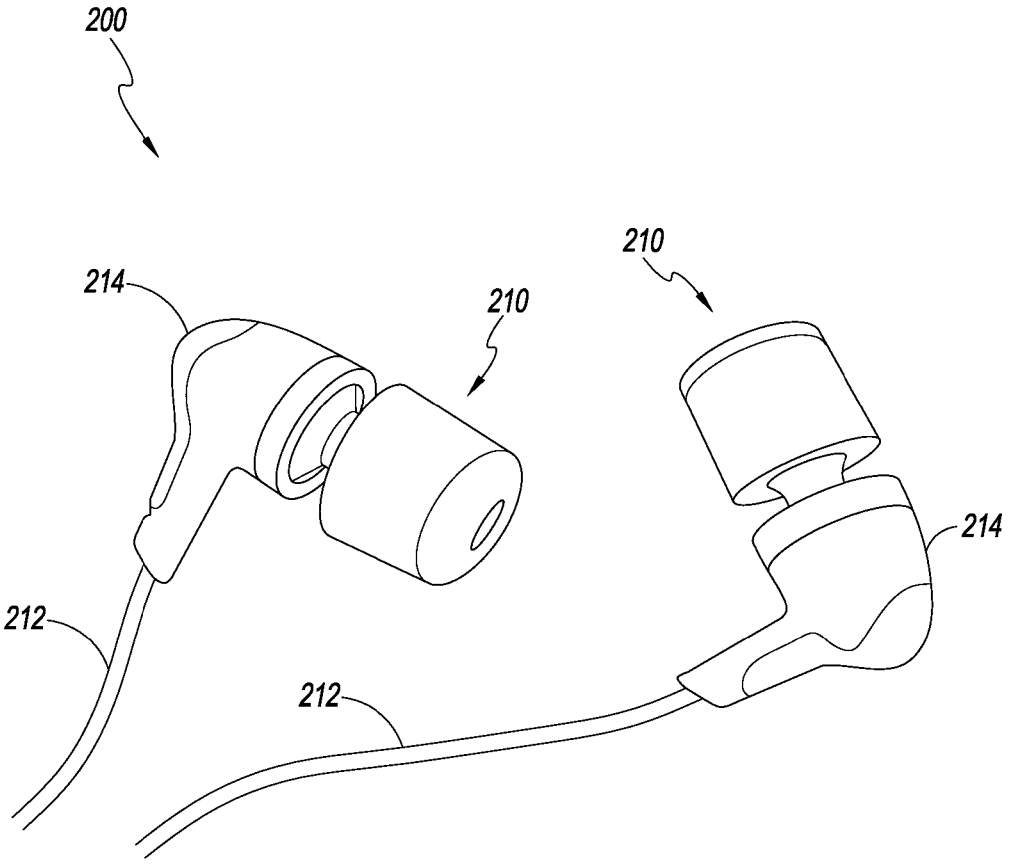
FIG. 2 depicts an embodiment of headphone assemblies of example headphones.

Turning to FIG. 2, a more detailed embodiment of the headphone assemblies 200 of an example headphone are shown. Headphone assemblies 200 include drivers or speakers 214, earpieces 210, and wires 212. The headphone assemblies 200 shown include an example innovative earpiece 210 that be made of foam, which may be comfortable and which may conform well to the shape of a listener's ear canal. Due to the conforming properties of this foam material, the earpieces 210 can form a close or tight coupling with the ear canal of the listener. As a result, the transfer of audio from the driver or speaker 214 of each earpiece can be performed with high fidelity so that the listener hears the audio with less noise from the listener's environment. Further, the audio enhancement system 114 described above can be designed so as to provide more effective enhancements for earphones, such as those shown, that provide good coupling with the ear canal or over the ears, as described above. In other embodiments, however, it should be understood that any other type of headphones or loudspeakers may be used together with the features of the audio enhancement system 114 described herein.

Figure 3:
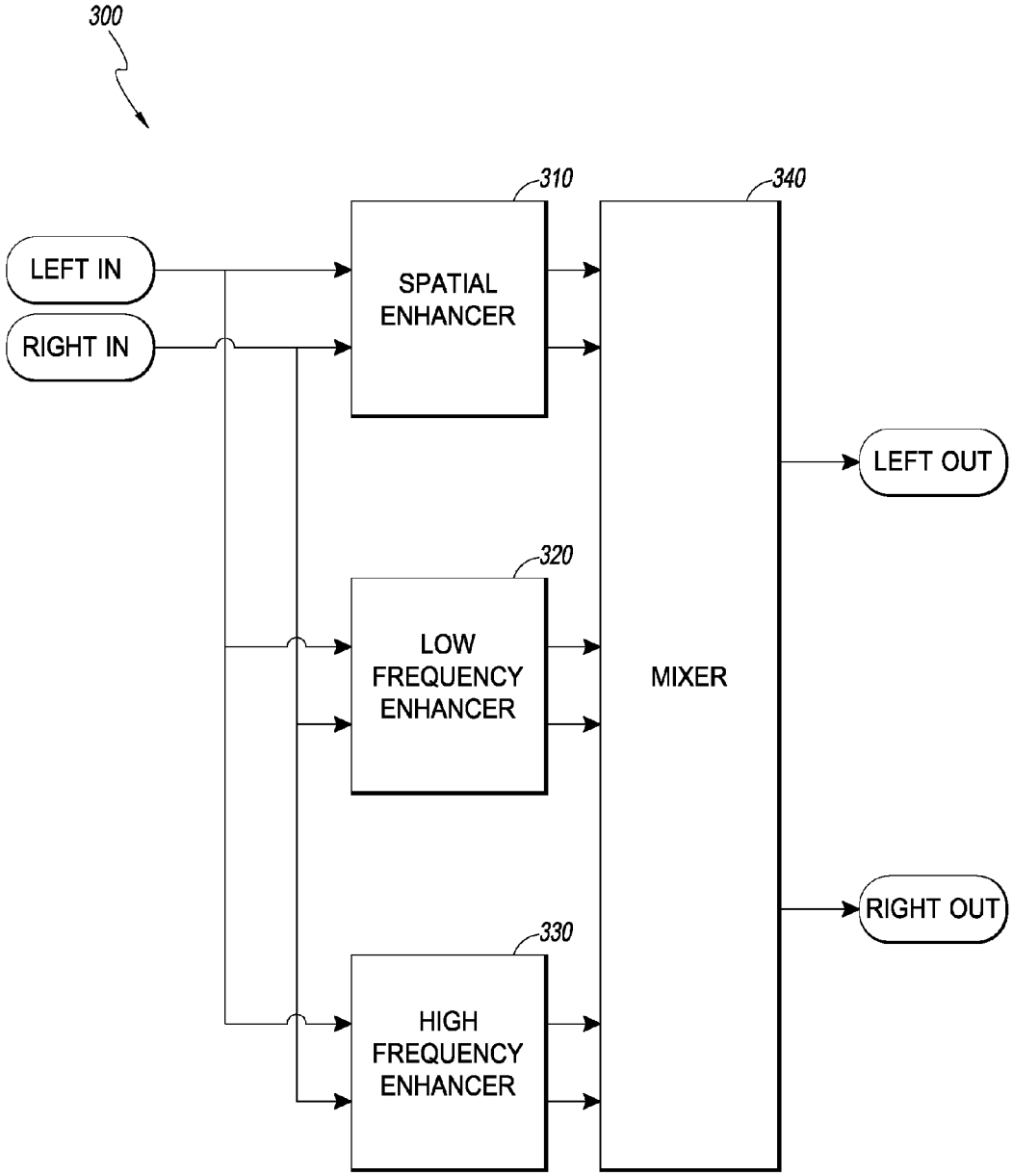
FIGS. 3 and 4 depict embodiments of audio enhancement systems.

Turning to FIG. 3, a more detailed embodiment of an audio enhancement system 300 is shown. The audio enhancement system 300 can perform any of the functionality described above with respect to the audio enhancement system 114 of FIG. 1A or 1B. Further, it should be understood that whenever this specification refers to an audio enhancement system, whether it be the audio enhancement system 114, 300, or additional examples of the audio enhancement system that follow, it may be understood that these embodiments may be implemented together herein.

The audio enhancement system 300 receives left and right inputs and outputs left and right outputs. The left and right inputs may be input audio signals, input audio channels, or the like. The left and right stereo inputs may be obtained from a locally-stored audio file or by a downloaded audio file or streamed audio file, as described above. The audio from the left and right inputs is provided to three separate enhancement modules 310, 320 and 330. These modules 310, 320, 330 are shown logically in parallel, indicating that their processing may be performed independently of each other. Independent processing or logically parallel processing can ensure or attempt to ensure that user adjustment of a gain in one of the enhancements does not cause overload or clipping in another enhancement (due to multiplication of gains in logically serial processing). The processing of these modules 310, 320, 330 may be actually performed in parallel (e.g., in separate processor cores, or in separate logic paths of an FPGA or in DSP or computer programming code), or they may be processed serially although logically implemented in parallel.

The enhancement modules 310, 320, 330 shown include a spatial enhancer 310, a low-frequency enhancer 320, and a high-frequency enhancer 330. Each of the enhancements 310, 320 or 330 can be tuned independently by the user or by a provider of the audio enhancement system 300 to sound better based on the particular type of headphones used, user device used, or simply based on user preferences.

In an embodiment, the spatial enhancer 310 can enhance difference information in the stereo signals to create a sense of ambiance or greater stereo separation. The difference information present in the stereo signals can naturally include a sense of ambiance or separation between the channels, which can provide a pleasing stereo effect when played over loudspeakers. However, since the speakers in headphones are close to or in the listener's ears and bypass the outer ear or pinna, the stereo separation actually experienced by a listener in existing audio playback systems may be inaccurate and overly discrete. Thus, the spatial enhancer 310 can emphasize the difference information so as to create a greater sense of spaciousness to achieve an improved stereo effect and sense of ambience with headphones.

The low-frequency enhancer 320 can boost low-bass frequencies by emphasizing one or more harmonics of an unreproducible or attenuated fundamental frequency. Low-bass signals, like other signals, can include one or more fundamental frequencies and one or more harmonics of each fundamental frequency. One or more of the fundamental frequencies may be unreproducible, or only producible in part by a headphone speaker. However, when a listener hears one or more harmonics of a missing or attenuated fundamental frequency, the listener can perceive the fundamental to be present, even though it is not. Thus, by emphasizing one or more of the harmonics, the low-frequency enhancer 320 can create a greater perception of low bass frequencies than are actually present in the signal.

The high-frequency enhancer 330 can emphasize high frequencies relative to the low frequencies emphasized by the low-frequency enhancer 320. This high-frequency enhancement can adjust a poor high-frequency response of a headphone speaker.

Each of the enhancers 310, 320 and 300 can provide left and right outputs, which can be mixed by a mixer 340 down to the left and right outputs provided to the headphones (or to subsequent processing prior to being output to the headphones). A mixer 340 may, for instance, mix each of the left outputs provided by the enhancers 310, 320 and 330 into the left output and similarly mix each of the right outputs provided by the enhancers 310, 320 and 330 into the right output.

Advantageously, in certain embodiments, because the enhancers 310, 320 and 330 are operated in different processing paths, they can be independently tuned and are not required to interact with each other. Thus, a user (who may be the listener or a provider of the user device, audio enhancement system 300, or headphones) can independently tune each of the enhancements in one embodiment. This independent tuning can allow for greater customizability and control over the enhancements to respond to a variety of different types of audio, as well as different types of headphones and user devices.

Although not shown, the audio enhancement system 300 may also include acoustic noise cancellation (ANC) or attenuation features in some embodiments, among possibly other enhancements.

Figure 4:
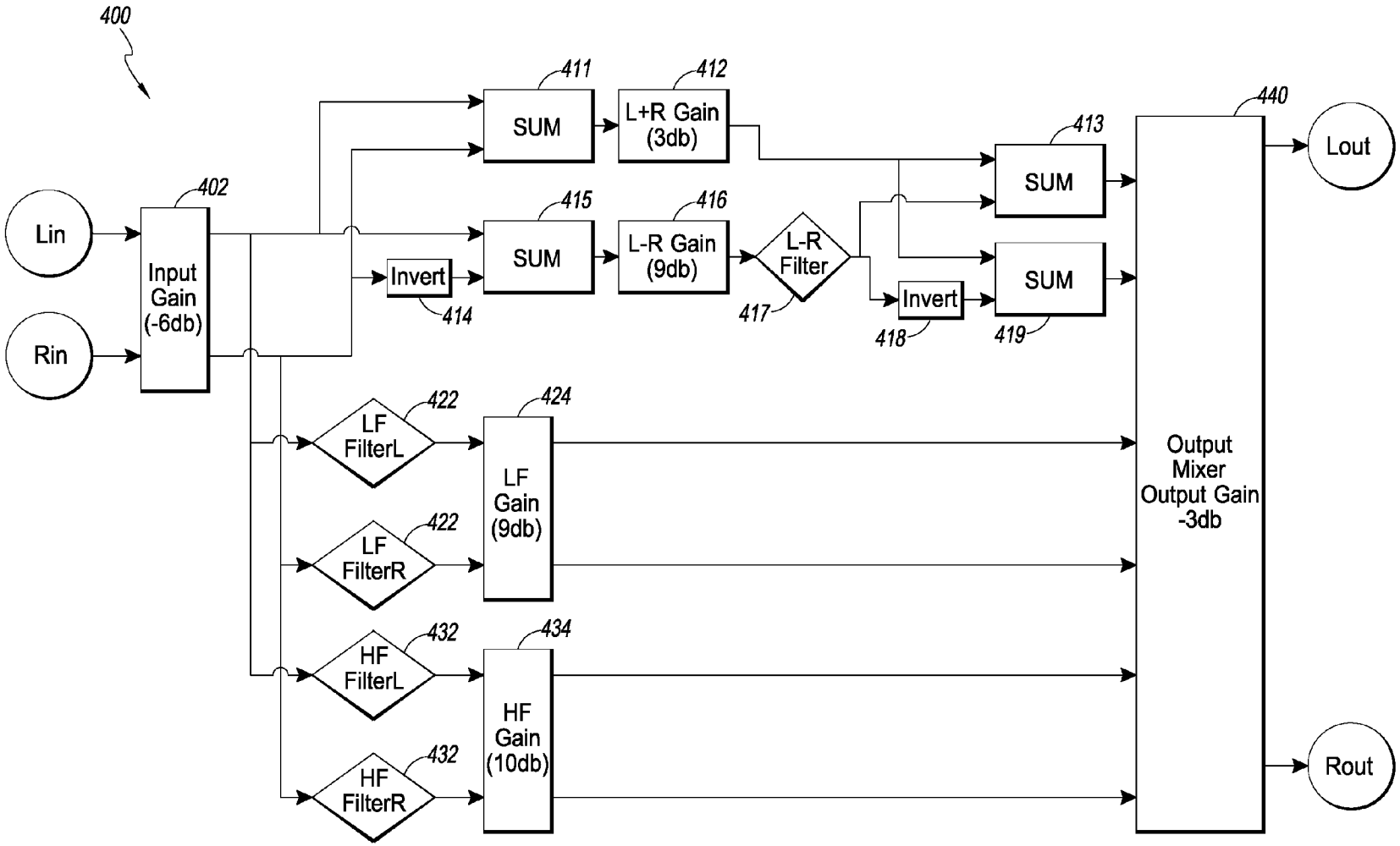

Turning to FIG. 4, a more detailed embodiment of the audio enhancement system 300 is shown, namely, the audio enhancement system 400. The audio enhancement system 400 may also include all of the features of the audio enhancement system 114 and 300 described above. Like the audio enhancement system 300, the audio enhancement system 400 receives left and right inputs and produces left and right outputs. The audio enhancement system 400 includes components for spatial enhancement (components 411-419), components for low-frequency enhancement (components 422-424), and components for high-frequency enhancement (components 432-434). The audio enhancement system 400 also includes a mixer (440) which also may include all of the features of the mixer 340 described above.

In the depicted embodiment, the left and right inputs are provided to an input gain block 402, which can provide an overall gain value to the inputs, which may affect the overall output volume at the outputs. Similarly, an output gain block may be provided before the outputs, although not shown, instead of or in addition to the input gain block 402. An example −6 dB default gain is shown for the input gain block 402, but a different gain may be set by the user (or the block 402 may be omitted entirely). The output of the input gain block 402 is provided to the spatial enhancement components, low-frequency enhancement components, and high-frequency enhancement components referred to above.

Starting with the spatial enhancement components, the left (L) and right (R) outputs are provided from the gain block 402 to a sum block 411, where they are summed to provide an L+R signal. The L+R signal may include the mono or common portion of the left and right signals. The L+R signal is supplied to a gain block 412, which applies a gain to the L+R signal, the output of which is provided to another sum block 413. The gain block 412 may be user-settable, or it may have a fixed gain.

In addition, the left input signal is supplied from the input gain block 402 to a sum block 415, and the right input signal is provided from the input gain block 402 to an inverter 414, which inverts the right input signal and supplies the inverted right input signal to the sum block 415. The sum block 415 produces an L−R signal, or a difference signal, that is then supplied to the gain block 416. The L−R signal can include difference information between the two signals. This difference information can provide a sense of ambience between the two signals.

The gain block 416 may be user-settable, or it may have a fixed gain. The output of the gain block 416 is provided to an L−R filter 417, also referred to herein as a difference filter 417. The difference filter 417 can produce a spatial effect by spatially enhancing the difference information included in the L−R signal. The output of the L−R filter 417 is supplied to the sum block 413 and to an inverter 418, which inverts the output of the L−R signal. The inverter 418 supplies an output to another sum block 419. Thus, the sum block 413 sums inputs from the L+R gain block 412 and the output of the L−R filter 417, while the sum block 419 sums the output of the L+R gain block 412 and the inverted output of the inverter 418.

Each of the sum blocks 413, 419 supplies an output to the output mixer 440. The output of the sum block 413 can be a left output signal that can be mixed down to the overall left output provided by the output mixer 440, while the output of the sum block 419 can be a right output that the output mixer 440 mixes down to the overall right output.

Referring to the low-frequency enhancement components, the output of the input gain block 402 is provided to low-frequency filters 422 including a low-frequency filter for the left input signal (LF FilterL) and a low-frequency filter for the right input signal (LF FilterR). Each of the low-frequency filters 422 can provide a low-frequency enhancement. The output of each filter is provided to a low-frequency gain block 424, which may be user-adjustable or which may be a fixed gain. The outputs of the low-frequency gain block 424 are provided to the output mixer 440, which mixes the left output from the low-frequency left filter down to the overall left output provided by the output mixer 440 and mixes the right output of the left frequency right filter to the overall right output provided by the output mixer 440.

Regarding the high-frequency enhancement components, the left and right inputs that have been supplied through the input gain block 402 are then applied also to the high-frequency filters 432 for both left (HF FilterL) and right inputs (HF FilterR). The high-frequency filters 432 can provide a high-frequency enhancement, which may emphasize certain high frequencies. The output of the high-frequency filters 432 is provided to high-frequency gain block 434, which may apply a user-adjustable or fixed gain. The output of the high-frequency gain block 434 is supplied to the output mixer 440 which, like the other enhancement blocks above, can mix the left output from the left high-frequency filter down to the left overall output from the output mixer 440 and can mix the right output from the right high-frequency filter 432 to the overall right output provided by the output mixer 440. Thus, the output mixer 440 can sum each of the inputs from the left filters and sum block 413 to a left overall output and can sum each of the inputs from the right filters and sum block 419 to a right overall output. In other embodiments, the output mixer 440 may also include one or more gain controls in any of the signal paths to adjust the amount of mixing of each input into the overall output signals.

In another embodiment, the filters shown, including the L−R filter 417, the low-frequency filters 422, and/or the high-frequency filters 432 can be implemented as infinite impulse response, or IIR filters. Each filter may be implemented by one or more first- or second-order filters, and in one embodiment, are implemented with second-order filters in a bi-quad IIR configuration. IIR filters can provide advantages such as low processing requirements and higher resolution for low frequencies, which may be useful for being implemented in a low-end processor of a user device or in a headphone and for providing finer control over low-frequency enhancement.

In other embodiments, finite impulse response filters, or FIR filters, may be used instead of IIR filters, or some of the filters shown may be IIR filters while others are FIR filters. However, FIR filters, while providing useful passband phase linearity, such passband phase linearity may not be required in certain embodiments of the audio enhancement system 400. Thus, it may be desirable to use IIR filters in place of FIR filters in some implementations.

Conceptually, although two filters are shown as low-frequency filters 422 in FIG. 4, one block of software code or hardware logic can be used to filter both the left and right inputs separately. Likewise, the high-frequency filters 432, although shown in separate filters in FIG. 4, may be implemented as one code module or set of logic circuitry in the processor, although applied separately to the left and right inputs. Alternatively, separate instances of each filter may be stored in memory and applied to left and right signals separately.

Figure 5:
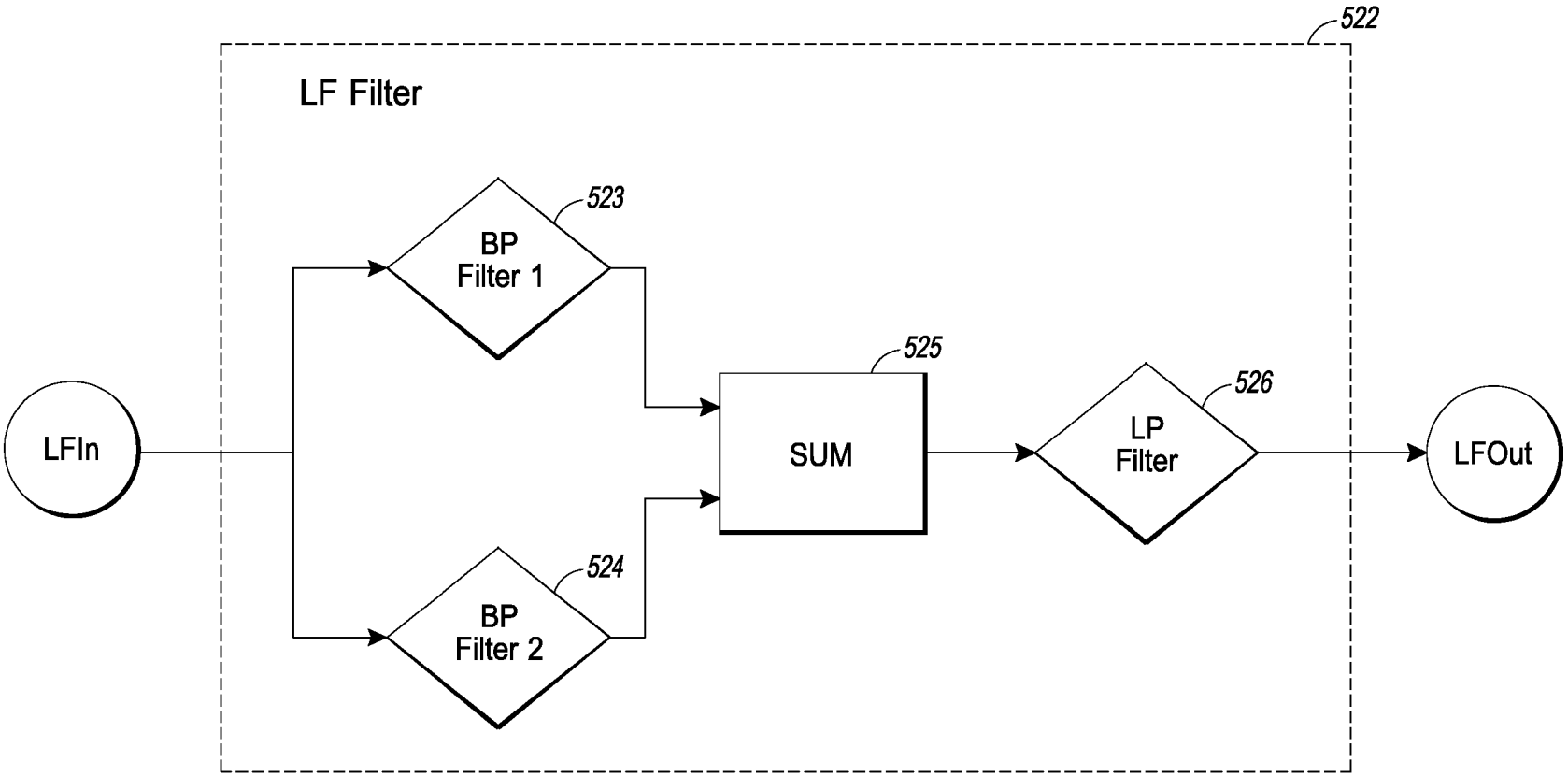
FIG. 5 depicts an embodiment of a low-frequency filter.

Turning to FIG. 5, a more detailed embodiment of the low-frequency filters 422 is shown. One low-frequency filter 522 is shown that may be used or applied separately to the left input and separately to the right input. In the embodiment shown in FIG. 5, the low-frequency filter 522 receives an input, which may be the left or right input, and produces a low-frequency output. The low-frequency filter 522 includes band pass filters 523 and 524. The input signals provided to each of the band pass filters 523 524, the output of which is provided to a sum block 525. The output of the sum block is supplied to a low-pass filter 526, which supplies the overall low-frequency output that can be provided by the low-frequency filter in FIG. 4 to the low-frequency gain block 424.

Although only two band pass filters 523 and 524 are shown, fewer or more than two band pass filters may be provided in other embodiments. The band pass filters 523 and 524 may have different center frequencies. Each of the band pass filters 523 and 524 can emphasize a different aspect of the low-frequency information in the signal. For instance, one of the band pass filters 523 or 524 can emphasize the first harmonics of a typical bass signal, and the other band pass filter can emphasize other harmonics. The harmonics emphasized by the two band pass filters can cause the ear to nonlinearly mix the frequencies filtered by the band pass filters 523 and 524 so as to trick the ear into hearing the missing fundamental. The difference of the harmonics emphasized by the band pass filters 523 and 524 can be heard by the ears as the missing fundamental.

Figure 7:
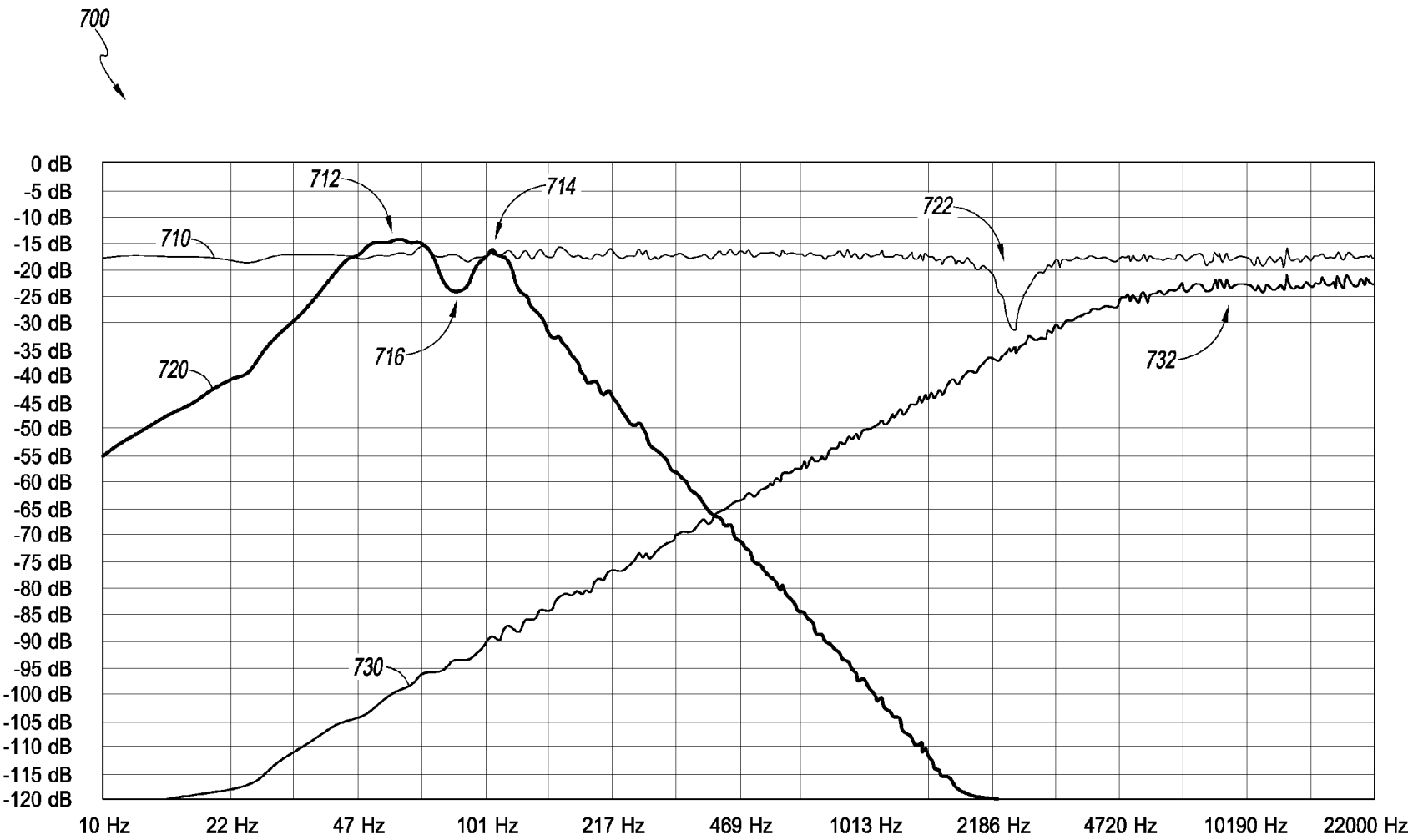
FIG. 7 depicts an example plot illustrating example frequency responses of the low-frequency filter, the difference filter, and a high-pass filter.
Figure 8:
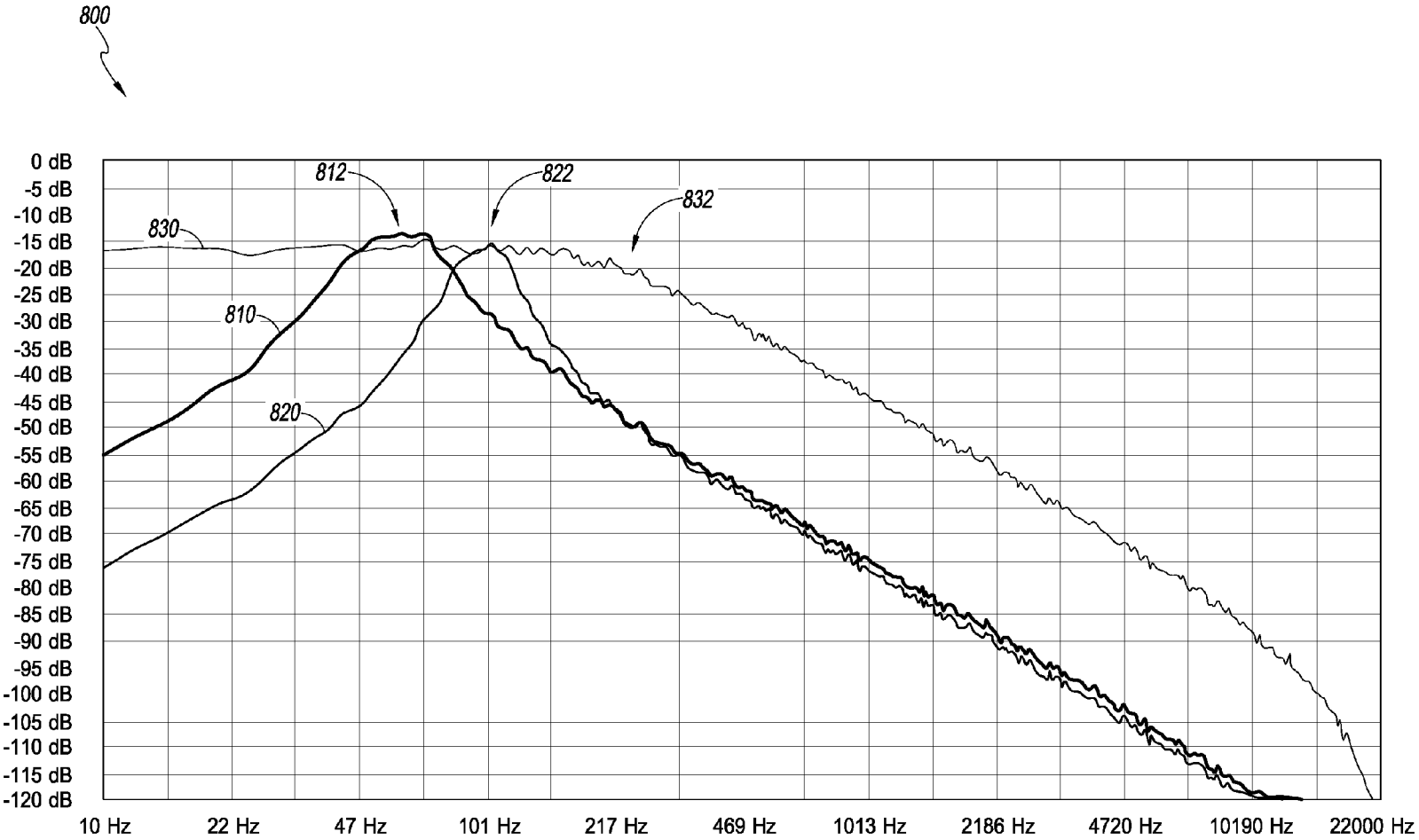
FIG. 8 depicts an example plot illustrating example frequency responses of component filters of the low-frequency filter.

Referring to FIG. 8, an example plot 800 is shown that depicts example frequency responses 810, 820 and 830 of example filters that correspond to the filters 523 524 and 526 shown in FIG. 5. In particular, the frequency responses 810 and 820 correspond to the example band pass filters 523 and 524, while the frequency response 830 corresponds to the low-pass filter 526. A combination of the various frequency responses of FIG. 8 is shown in FIG. 7 as a frequency response 720, which will be described in greater detail below.

Referring again to FIG. 8, in the plot 800, the frequency response 810 has a center frequency of about 60 Hz and may have a center frequency between about 50 and about 75 Hz in other embodiments. The frequency response 820 has a center frequency centered at about 100 Hz and between about 80-120 Hz in other embodiments. Thus, the difference between harmonics emphasized by these frequencies can be heard as a missing fundamental by the ear. If, for instance, the frequencies emphasized by the band pass filter 523 represented by frequency response 810 are at 60 Hz, and the frequencies emphasized by the band pass filter 524 represented by frequency response 820 are at 100 Hz, the difference between 100 Hz and 60 Hz is 40 Hz, resulting in the listener perceiving the hearing of the 40 Hz fundamental, even though the 40 Hz fundamental is not reproducible or is less reproducible by many headphone speakers.

The frequency response 830 of the low-pass filter 526 of FIG. 5 has a 40 dB per decade or 12 db per octave roll-off, as it is a second-order filter in one embodiment, and thus acts to attenuate or separate the low-frequency enhancement from the spatial enhancement in the high-frequency enhancement.

Figure 6A:
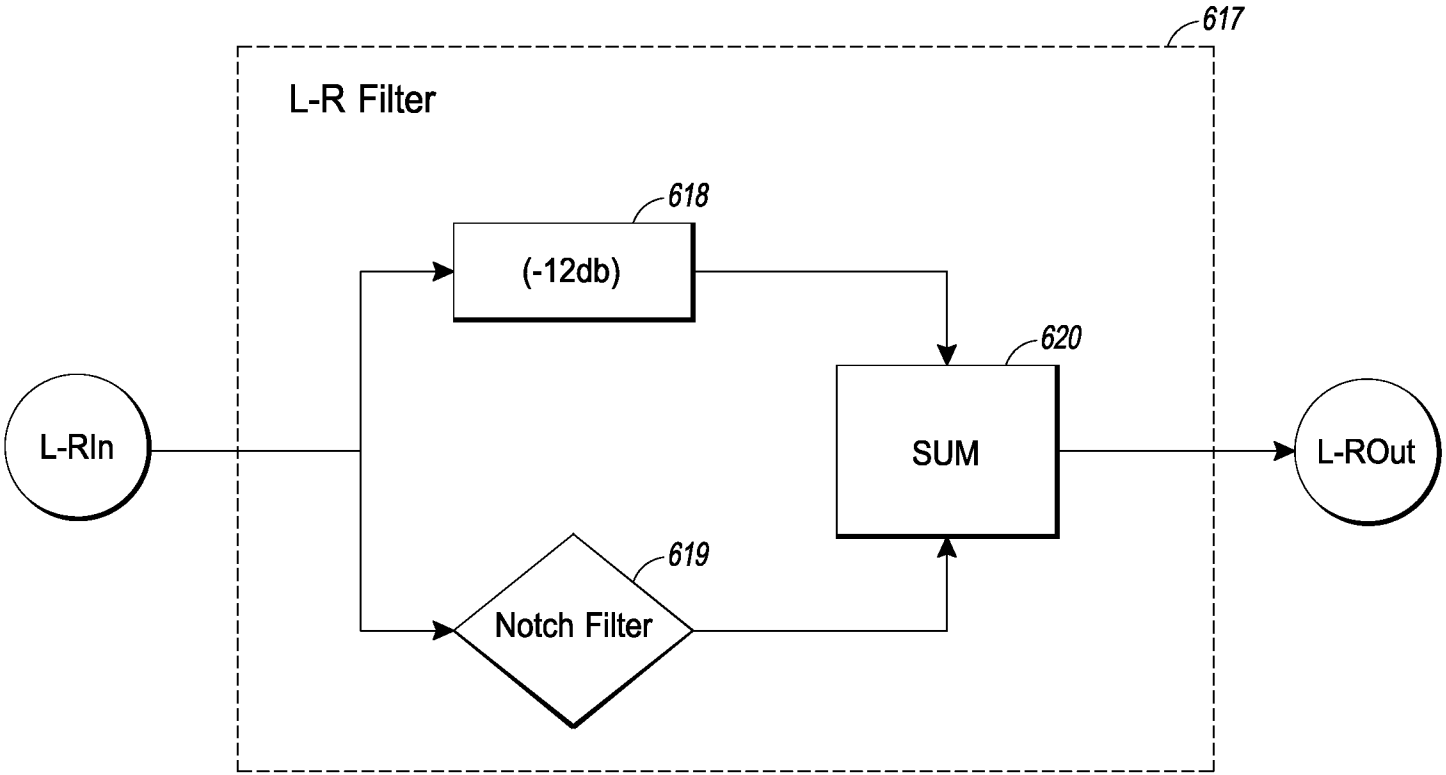
FIGS. 6A and 6B depict embodiments of a difference filter.

Turning to FIG. 6A, an example spatial enhancement filter or difference filter 617 is shown. The filter 617 is a more detailed example of the difference filter 417 in FIG. 4. The difference filter 617 receives an L−R input and produces an L−R output that has been filtered. The L−R input is supplied to a notch filter 619 and a gain block 618. The output of the gain block 618 and the notch filter 619 are supplied to a sum block 620, which sums the gained output with the filtered output to produce the L−R overall output.

The notch filter 619 is an example of a band stop filter. The combined notch filter 619, gain block 618, and sum block 620 can create a spatial enhancement effect in one embodiment by de-emphasizing certain frequencies that many listeners perceive as coming from the front of a listener. For instance, referring to FIG. 9, an example difference filter is shown in a plot 900 by frequency response 910. Frequency response 910 is relatively flat throughout the spectrum, except at notch 912. Notch 912 is centered at about 2500 Hz, although it may be centered at another frequency, such as 2400 Hz, or in a range of 2400-2600 Hz, or in a range of 2000-3000 Hz, or some other range. The notch 912 is relatively deep, extending −30 dB below the flat portion or flatter portion of the frequency response 910 and has a relatively high Q factor, with a bandwidth of approximately 870 Hz extending from a 3 dB cutoff of about 2065 Hz to about 2935 Hz (or about 2200 Hz to about 2900 Hz, or some other optional range). These values may be varied in other embodiments. As used herein, the term "about," in addition to having its ordinary meaning, when used with respect to frequencies, can mean a difference of within 1%, or a difference of within 5%, or a difference of within 10%, or some other similar value.

For many people, the ear is very sensitive to speech coming from the front of a listener in a range around about 2500 Hz or about 2600 Hz. Because speech predominantly occurs at a range centered at about 2500 Hz or about 2600 Hz, and because people typically talk to people directly in front of them, the ears tend to be very sensitive to distinguishing sound coming from the front of a listener at these frequencies. Thus, by attenuating these frequencies, the difference filter 617 of FIG. 6 can cause a listener to perceive that audio is coming less from the front and more from the sides, enhancing a sense of spaciousness in the audio. Applying both the gain block 618 and the notch filter 619 to the difference signal in the difference filter 617 can produce an overall frequency response that reduces frequencies proportional to, equal to, or about equal to what is emphasized by a normal or average human hearing system. Since the normal hearing system emphasizes frequencies in a range around about 2500 Hz by about 13 dB to about 14 dB, the combined output of the gain block 618 and notch filter 619 (via sum block 620) can correspondingly reduce frequencies around about 2500 Hz by about −13 dB to about −14 dB.

Figure 6B:
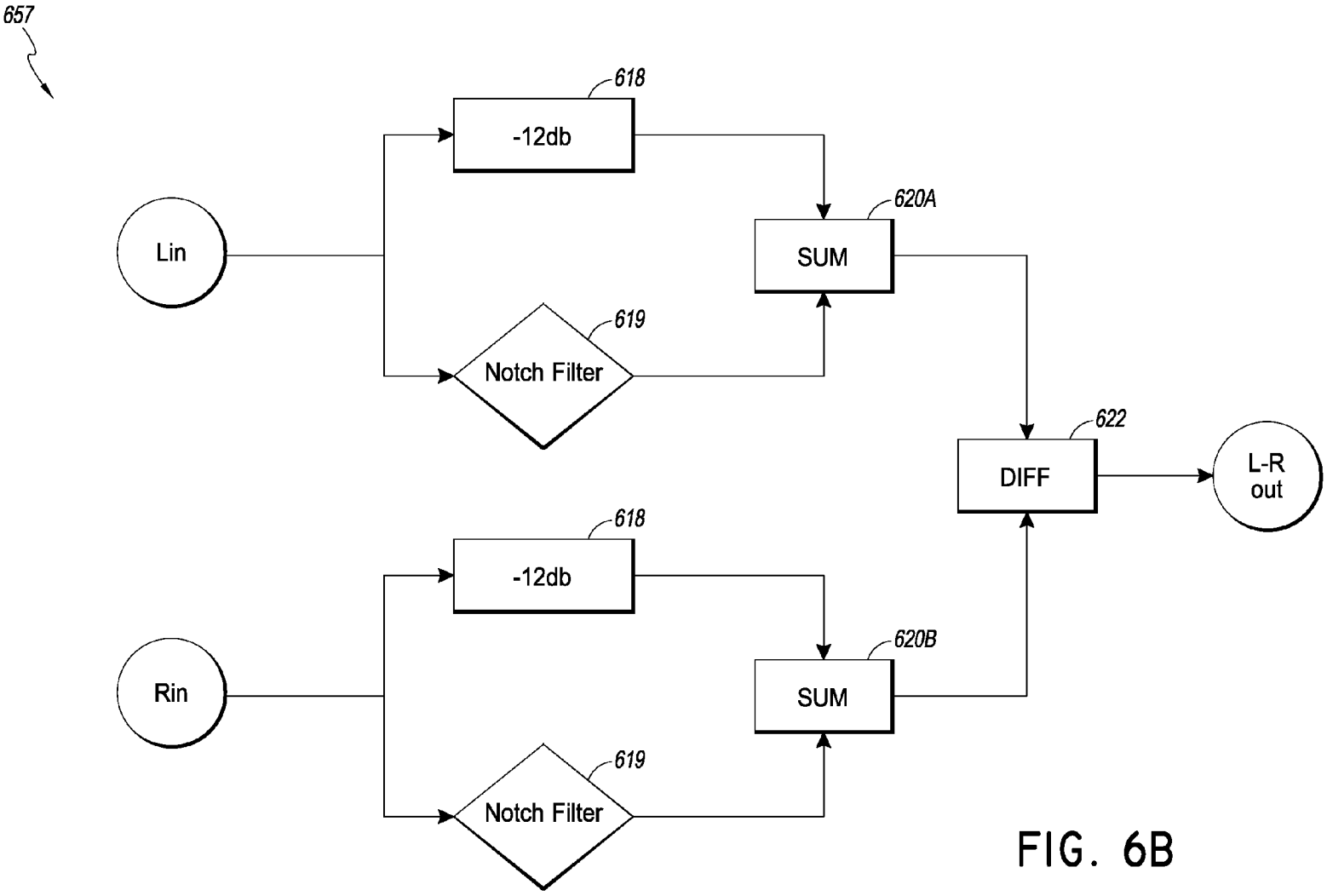

FIG. 6B depicts another embodiment of a spatial enhancement filter 657. The spatial enhancement filter 657 can operate on the same principles as the difference filter 617. However, in the filter 657, the filter 617 of FIG. 6A is applied separately to left and right input signals. The output of each filter (at sum blocks 620A, 620B) is supplied to a difference block 622, which can subtract the left minus the right signal (or vice versa) to produce a filtered difference output. Thus, the filter 657 can be used in place of the filter 617 in the system 400, for example, by replacing blocks 414, 415, and 417 in FIG. 4 with the blocks shown in FIG. 6B. The L−R gain block 416 of FIG. 4 may be inserted directly after each Lin, Rin input signal in FIG. 6B or after the difference block 622 of FIG. 6B, among other places.

Turning to FIG. 7, another example plot 700 is shown, which as described above, includes a frequency response 720 corresponding to the output of the low-frequency enhancement filter 522 as well as a frequency response 710 corresponding to the example difference filter 617. The plot 700 also includes a frequency response 730 corresponding to the example high-pass filter 432 described above.

The low-frequency response 720, as described above, includes two pass bands 712 and 714 and a valley 617 caused by the band pass filters, followed by a roll-off after the pass band 714. The bandwidth of the first pass band 712 is relatively wider than the bandwidth of the second pass band 714 in the example embodiment shown due to the truncation of the second peak by the low pass filter response 830 (see FIG. 8). The effect of the low pass filter (526; see FIG. 5) may be to truncate the bandwidth of the second band pass filter (524) to reduce the second band pass filter's impact on the vocal frequency range. Without the low pass filter, the peak 714 or pass band of the second band pass filter might extend too far into the voice band and emphasize low frequency speech in an unnatural manner. Further, the gain of the first pass band 712 is higher than the second pass band 714 by about 1 to 2 dB to better emphasize the lower frequencies. Too much gain in the second pass band 714 may result in muddier sound; thus, the difference in gain can provide greater clarity in the perceived low-bass audio.

Figure 9:
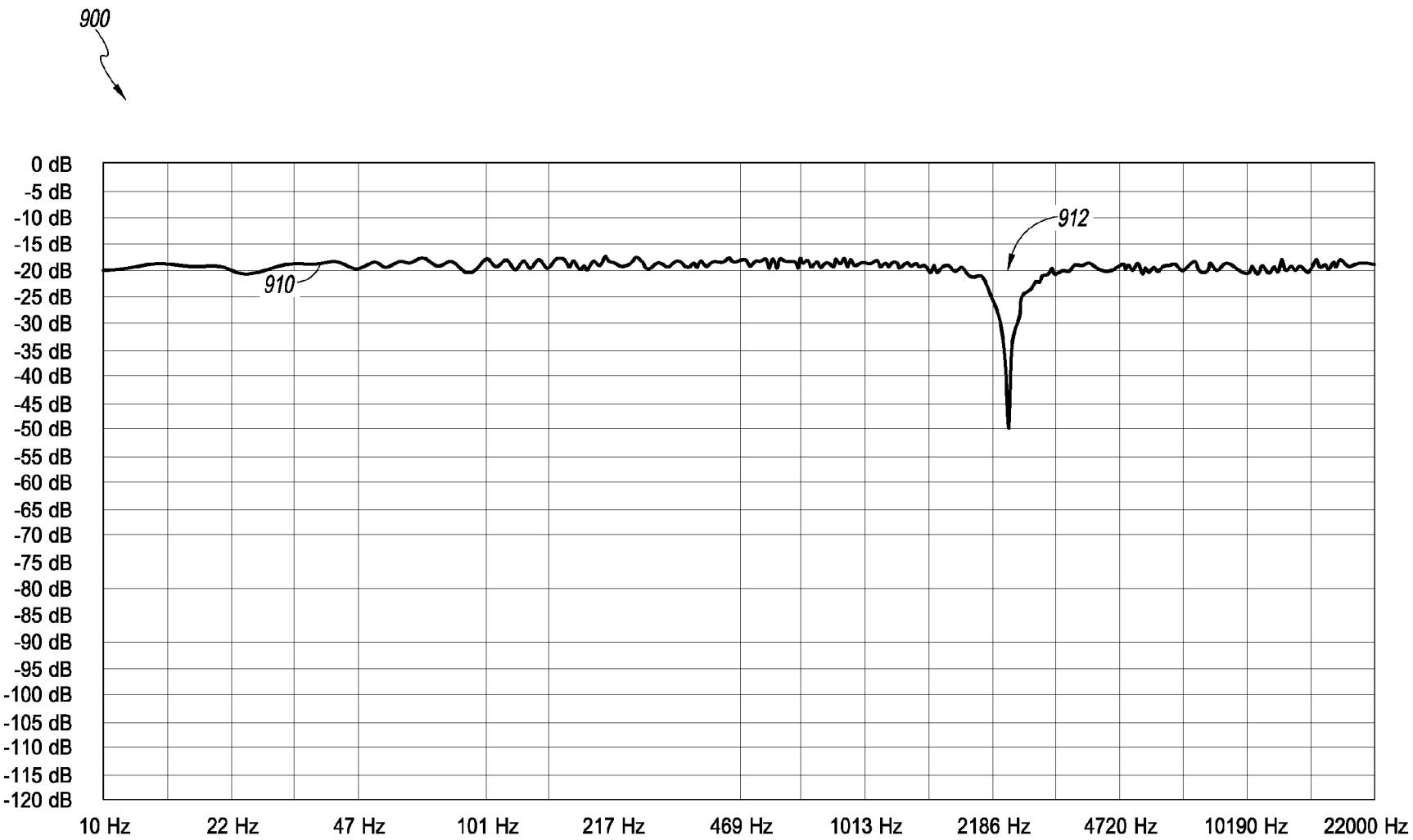
FIG. 9 depicts an example plot illustrating an example frequency response of a difference filter.

The frequency response 710 of the difference filters described above includes a notch 722 that reflects both the deep notch 912 of FIG. 9 as well as the gain block 618 and summation block 620 of FIG. 6. Thus, the combined frequency response 710 from the notch filter 619 and gain block 618 can also be considered a notch filter. The high-frequency response 730 is shown having a 40 dB per decade or 12 db per octave roll-off corresponding to a second-order filter, as one example, although other roll-offs may be included, with a cutoff at about 5 kHz, although this cutoff frequency may be varied in other embodiments.

Figure 10:
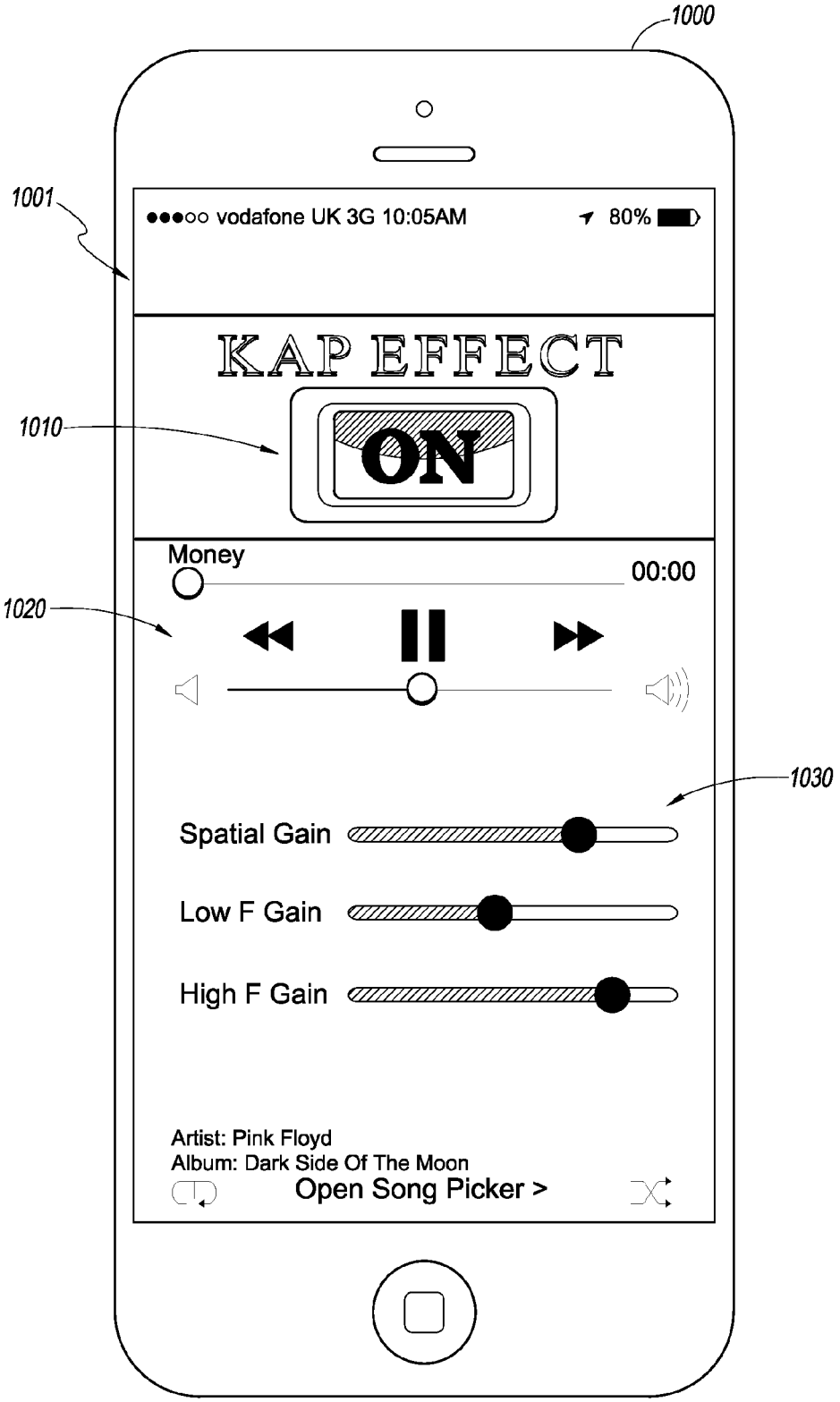
FIG. 10 depicts an example user device having an example user interface that can control the audio enhancement system.

Turning to FIG. 10, an example user device 1000 is shown that can implement any of the features described above. The user device 1000 is an example phone, which is an example of the user device 110 described above. The user device 1000 includes a display 1001. On the display 1000 is an enhancement selection control 1010 that can be selected by a user to turn on or turn off enhancements of the audio enhancement systems described above. In another embodiment, the enhancement selection control 1010 can include separate buttons for the spatial, low-frequency, and high-frequency enhancements to individually turn on or off these enhancements.

Playback controls 1020 are also shown on the display 1000, which can allow a user to control playback of audio. Enhancement gain controls 1030 on the display 1000 can allow a user to adjust gain values applied to the separate enhancements. Each of the enhancement gain controls includes a slider for each enhancement so that the gain is selected based on a position of the slider. In one embodiment, moving the position of the slider to the right causes an increase in the gain to be applied to that enhancement, whereas moving position of the slider to the left decreases the gain applied to that enhancement. Thus, a user can selectively emphasize one of the enhancements over the others, or equally emphasize them together.

Selection of the gain controls by a user can cause adjustment of the gain controls shown in FIG. 4. For instance, selection of the spatial frequency enhancement gain control 1030 can adjust the gain block 416. Selection of the low-frequency gain control 1030 can adjust the gain of the gain block 424, and selection of the high-frequency gain control 1030 can adjust the gain of the high-frequency gain block 434.

Although sliders and buttons are shown as example user interface controls, many other types of user interface controls may be used in place of sliders and buttons in other embodiments.

III. Terminology

Many other variations than those described herein will be apparent from this disclosure. For example, depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. In addition, different tasks or processes can be performed by different machines and/or computing systems that can function together.

The various illustrative logical blocks, modules, and algorithm steps described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

The various illustrative logical blocks and modules described in connection with the embodiments disclosed herein can be implemented or performed by a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor can be a microprocessor, but in the alternative, the processor can be a controller, microcontroller, or state machine, combinations of the same, or the like. A processor can include electrical circuitry configured to process computer-executable instructions. In another embodiment, a processor includes an FPGA or other programmable device that performs logic operations without processing computer-executable instructions. A processor can also be implemented as a combination of computing devices, e.g., a combination of a DSP and a microprocessor, a plurality of microprocessors, one or more microprocessors in conjunction with a DSP core, or any other such configuration. A computing environment can include any type of computer system, including, but not limited to, a computer system based on a microprocessor, a mainframe computer, a digital signal processor, a portable computing device, a device controller, or a computational engine within an appliance, to name a few.

The steps of a method, process, or algorithm described in connection with the embodiments disclosed herein can be embodied directly in hardware, in a software module stored in one or more memory devices and executed by one or more processors, or in a combination of the two. A software module can reside in RAM memory, flash memory, ROM memory, EPROM memory, EEPROM memory, registers, hard disk, a removable disk, a CD-ROM, or any other form of non-transitory computer-readable storage medium, media, or physical computer storage known in the art. An example storage medium can be coupled to the processor such that the processor can read information from, and write information to, the storage medium. In the alternative, the storage medium can be integral to the processor. The storage medium can be volatile or nonvolatile. The processor and the storage medium can reside in an ASIC.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. Further, the term "each," as used herein, in addition to having its ordinary meaning, can mean any subset of a set of elements to which the term "each" is applied.

Disjunctive language such as the phrase "at least one of X, Y and Z," unless specifically stated otherwise, is to be understood with the context as used in general to convey that an item, term, etc. may be either X, Y, or Z, or a combination thereof. Thus, such conjunctive language is not generally intended to imply that certain embodiments require at least one of X, at least one of Y and at least one of Z to each be present.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments of the inventions described herein can be embodied within a form that does not provide all of the features and benefits set forth herein, as some features can be used or practiced separately from others.

What is claimed is:

1. A method of enhancing audio for headphones, the method comprising:

under control of a hardware processor:

receiving a left input audio signal;

receiving a right input audio signal;

obtaining a difference signal from the left and right input audio signals;

filtering the difference signal at least with a notch filter to produce a spatially-enhanced audio signal;

filtering the left and right input audio signals with at least two band pass filters to produce bass-enhanced audio signals;

filtering the left and right input audio signals with a high pass filter to produce high-frequency enhanced audio signals;

mixing the spatially-enhanced audio signal, the bass-enhanced audio signals, and the high-frequency enhanced audio signals to produce left and right headphone output signals; and outputting the left and right headphone output signals to headphones for playback to a listener.

2. The method of claim 1, wherein the notch filter of the spatial enhancer is configured to attenuate frequencies in a frequency band associated with speech.

3. The method of claim 2, wherein the notch filter is configured to attenuate frequencies in a frequency band centered at about 2500 Hz.

4. The method of claim 3, wherein the notch filter is configured to attenuate frequencies in a frequency band of at least about 2100 Hz to about 2900 Hz.

5. The method of claim 1, wherein a spatial enhancement provided by the notch filter is configured to be effective when the headphones are closely coupled with the listener's ears.

6. The method of claim 1, wherein the band pass filters are configured to emphasize harmonics of a fundamental that may be attenuated or unreproducible by headphones.

7. The method of claim 1, wherein the high pass filter is configured to have a cutoff frequency of about 5 kHz.

8. A system for enhancing audio for headphones, the system comprising:

a spatial enhancer configured to obtain a difference signal from a left input channel of audio and a right input channel of audio and to process the difference signal with a notch filter to produce a spatially-enhanced channel of audio;

a low frequency enhancer configured to process the left input channel of audio and the right input channel of audio to produce bass-enhanced channels of audio;

a high frequency enhancer configured to process the left input channel of audio and the right input channel of audio to produce high-frequency enhanced channels of audio; and a mixer configured to combine the spatially-enhanced channel of audio, the bass-enhanced channels of audio, and the high-frequency enhanced channels of audio to produce left and right headphone output channels;

wherein the spatial enhancer, the low frequency enhancer, the high frequency enhancer, and the mixer are implemented by one or more hardware processors.

9. The system of claim 8, wherein the notch filter of the spatial enhancer is configured to attenuate frequencies in a frequency band associated with speech.

10. The system of claim 9, wherein the notch filter is configured to attenuate frequencies in a frequency band centered at about 2500 Hz.

11. The system of claim 10, wherein the notch filter is configured to attenuate frequencies in a frequency band of at least about 2100 Hz to about 2900 Hz.

12. The system of claim 8, wherein a spatial enhancement provided by the notch filter is configured to be effective when the headphones are closely coupled with the listener's ears.

13. The system of claim 8, wherein the band pass filters are configured to emphasize harmonics of a fundamental that may be attenuated or unreproducible by headphones.

14. The system of claim 8, wherein the high pass filter is configured to have a cutoff frequency of about 5 kHz.

15. Non-transitory physical computer storage comprising instructions stored thereon that, when executed by a hardware processor, are configured to implement a system for enhancing audio for headphones, the system configured to:

filter left and right input audio signals with a notch filter to produce spatially-enhanced audio signals;

obtain a difference signal from the spatially-enhanced audio signals;

filter the left and right input audio signals with at least two band pass filters to produce bass-enhanced audio signals;

filter the left and right input audio signals with a high pass filter to produce high-frequency enhanced audio signals; and mix the difference signal, the bass-enhanced audio signals, and the high-frequency enhanced audio signals to produce left and right headphone output signals.

16. The non-transitory physical computer storage of claim 15, wherein the notch filter of the spatial enhancer is configured to attenuate frequencies in a frequency band associated with speech.

17. The non-transitory physical computer storage of claim 16, wherein the notch filter is configured to attenuate frequencies in a frequency band centered at about 2500 Hz.

18. The non-transitory physical computer storage of claim 17, wherein the notch filter is configured to attenuate frequencies in a frequency band of about 2100 Hz to about 2900 Hz.

19. The non-transitory physical computer storage of claim 15, wherein a spatial enhancement provided by the notch filter is configured to be effective when the headphones are closely coupled with the listener's ears.

20. The non-transitory physical computer storage of claim 15, wherein the band pass filters are configured to emphasize harmonics of a fundamental that may be attenuated or unreproducible by headphones.

* * * * *